US011389002B2

(12) United States Patent
Long

(10) Patent No.: US 11,389,002 B2
(45) Date of Patent: Jul. 19, 2022

(54) CHAIR WITH TEMPERATURE CONTROL

(71) Applicant: Oztent Australia Pty. Limited, Wetherill Park (AU)

(72) Inventor: Peter Long, Wetherill Park (AU)

(73) Assignee: Oztent Australia Pty. Limited, Wetherill Park (AU)

( * ) Notice: Subject to any disclaimer, the term of this patent is extended or adjusted under 35 U.S.C. 154(b) by 0 days.

(21) Appl. No.: 16/625,981

(22) PCT Filed: Jun. 22, 2018

(86) PCT No.: PCT/AU2018/000101
§ 371 (c)(1),
(2) Date: Dec. 23, 2019

(87) PCT Pub. No.: WO2019/000013
PCT Pub. Date: Jan. 3, 2019

(65) Prior Publication Data

US 2021/0153659 A1 May 27, 2021

(30) Foreign Application Priority Data

Jun. 28, 2017 (AU) ..... 2017902504

(51) Int. Cl.
*A47C 4/28* (2006.01)
*A47C 7/74* (2006.01)

(52) U.S. Cl.
CPC ..... *A47C 4/286* (2013.01); *A47C 7/748* (2013.01)

(58) Field of Classification Search
CPC ..... A47C 4/286; A47C 7/748
See application file for complete search history.

(56) References Cited

U.S. PATENT DOCUMENTS

| | | | | |
|---|---|---|---|---|
| 6,848,746 | B2 * | 2/2005 | Gentry | 297/380 |
| 8,870,281 | B1 | 10/2014 | Boone | |
| 9,074,793 | B1 | 7/2015 | Baureis | |
| 2004/0075311 | A1 * | 4/2004 | Linder | 297/188.04 |
| 2004/0155506 | A1 | 8/2004 | Gentry | |
| 2012/0313405 | A1 | 12/2012 | Eckman et al. | |

OTHER PUBLICATIONS

EPO Search Report for corresponding EP Application No. EP 18825171, dated Jan. 21, 2021, 7 pages.
International Search Report for PCT/AU2018/000101 dated Jul. 10, 2018, 3 pages.

* cited by examiner

*Primary Examiner* — Anthony D Barfield
(74) *Attorney, Agent, or Firm* — Dority & Manning, P.A.

(57) ABSTRACT

The present invention relates to an outdoor and/or collapsible chair (1), said chair (1) having: a frame (2), the frame (2) having a pair of elongate front members (4) spaced apart by at least one cross member (5); a pair of elongate rear members (7) spaced apart by at least one cross member (8); at least one side member (10) extending between each of said front and rear members (4, 7); a flexible seat (15), adapted in use to be supported by said frame (2) between said side members (10), said seat (15) having a bottom portion (17) and a back portion (18), said portions (17, 18) having a front surface (20) and a back surface (21); and at least one temperature controlling pocket (30) located adjacent said bottom portion (17) and/or said back portion (18) to provide in use temperature control to a region of a user when sitting in said chair (1).

13 Claims, 2 Drawing Sheets

CHAIR WITH TEMPERATURE CONTROL

PRIORITY CLAIM

This application is based upon and claims the right of priority under 35 U.S.C. § 371 to International Application No. PCT/AU2018/000101 filed on Jun. 22, 2018, which claims the benefit of AU Application Serial No. 2017902504 filed Jun. 28, 2017. Applicant claims priority to and the benefit of each of such applications and incorporates all such applications herein by reference in their entirety.

FIELD

The invention relates to a chair and in particular relates to either a folding camping style chair and/or a fixed chair having a temperature control system.

BACKGROUND

Chairs are used in daily life and are very common. Folding chairs are also common and particularly advantageous for use where space is minimal; the chair needs to be carried in a vehicle or to various locations away from a house or the like. For example, folding chairs are particularly popular at sporting events, camping, outdoor recreation, barbecues or the like.

Most outdoor folding chairs typically include a frame, feet and seat and back portions. In many folding chairs, the seat and back portion are a single piece of fabric held by the frame.

In an earlier invention by the Applicant the back portion included a lumbar support in the form of a belt extending around a rear of the fabric back portion and terminating at either of the front poles of the frame. The lumbar support being adjustable to provide support to a user when sitting in the chair and providing a better posture for a user.

Outdoor and/or folding chairs have also come with a range of add-ons such as cup-holders, phone holders, tables, feet rests and the like.

It has been noted that as a consequence of climate change with the increase of global warming it can now be excessively hot or cold when being outdoors. Accordingly, it would be advantageous to include some sort of temperature control and/or heating and cooling system in cooperation with either an outdoor or foldable chair.

However, due to outdoor or foldable chairs being light weight, in many cases collapsible and as small as possible, any such heating or cooling system must be minimal in size and weight. Also, due to the locations where portable chairs are typically taken, there is likely no power available to be used to heat or cool the chair. Therefore, a heating or cooling system requiring power is not convenient.

Existing active heating systems (for example resistant coil heating elements) rely on batteries for power and/or direct connection to a power supply. These types of active heating systems relying on a power supply are inefficient, produce little heat or cooling and the operating time is short. They also take a considerable amount of time to recharge if using a battery and are expensive to run, are heavy, bulky and are just not convenient, practical or pleasant to view.

Accordingly, there is a need for an outdoor and/or collapsible chair that uses a passive (exothermic chemical reaction) system to provide heating and/or cooling in a small space without adversely effecting the size, weight, collapsibility and aesthetic looks of a collapsible chair.

OBJECT OF THE INVENTION

It is an object of the present invention to substantially overcome or at least ameliorate one or more of the disadvantages of the prior art, or to at least provide a useful alternative.

SUMMARY OF INVENTION

There is disclosed herein an outdoor and/or collapsible chair, said chair having:

a frame, the frame having a pair of elongate front members spaced apart by at least one cross member; a pair of elongate rear members spaced apart by at least one cross member; at least one side member extending between each of said front and rear members;

a flexible seat, adapted in use to be supported by said frame between said side members, said seat having a bottom portion and a back portion, said portions having a front surface and a back surface;

at least one temperature controlling pocket located adjacent said bottom portion and/or said back portion to provide in use temperature control to a region of a user when sitting in said chair.

Preferably, said pocket is formed into said bottom portion and/or said back portion.

Preferably, said pocket includes fastening means to close a pocket opening.

Preferably, said pocket is adapted to receive a temperature controlling device.

Preferably, said pocket includes a temperature controlling lining.

Preferably, said lining includes heat reflective material.

Preferably, said chair includes a cushioned portion, said pocket located substantially within said cushion.

Preferably, said temperature controlling device is exothermic.

Preferably, said temperature controlling device includes sodium acetate.

Preferably, said chair includes a plurality of pockets providing in use heating and/or cooling to a user.

Preferably, said chair includes a lumbar support.

Preferably, said lumbar support is integrally formed with said temperature controlling device to direct heating or cooling to a targeted area of a user.

Preferably, said pocket is releasably attachable to said chair.

BRIEF DESCRIPTION OF DRAWINGS

A preferred embodiment of the invention will now be described, by way of example only, with reference to the accompanying drawings, wherein.

DESCRIPTION OF EMBODIMENTS

Figure 1:
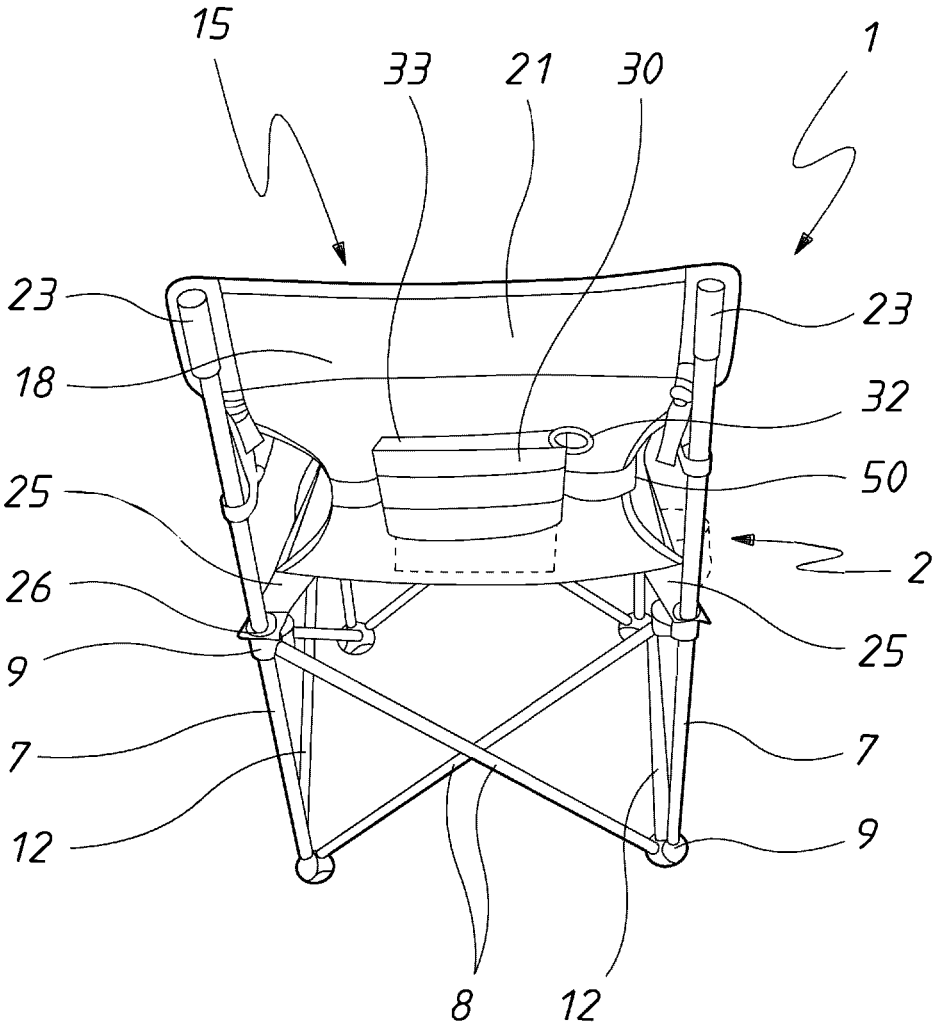
FIG. 1 shows a perspective rear view of an embodiment of the present invention.
Figure 2:
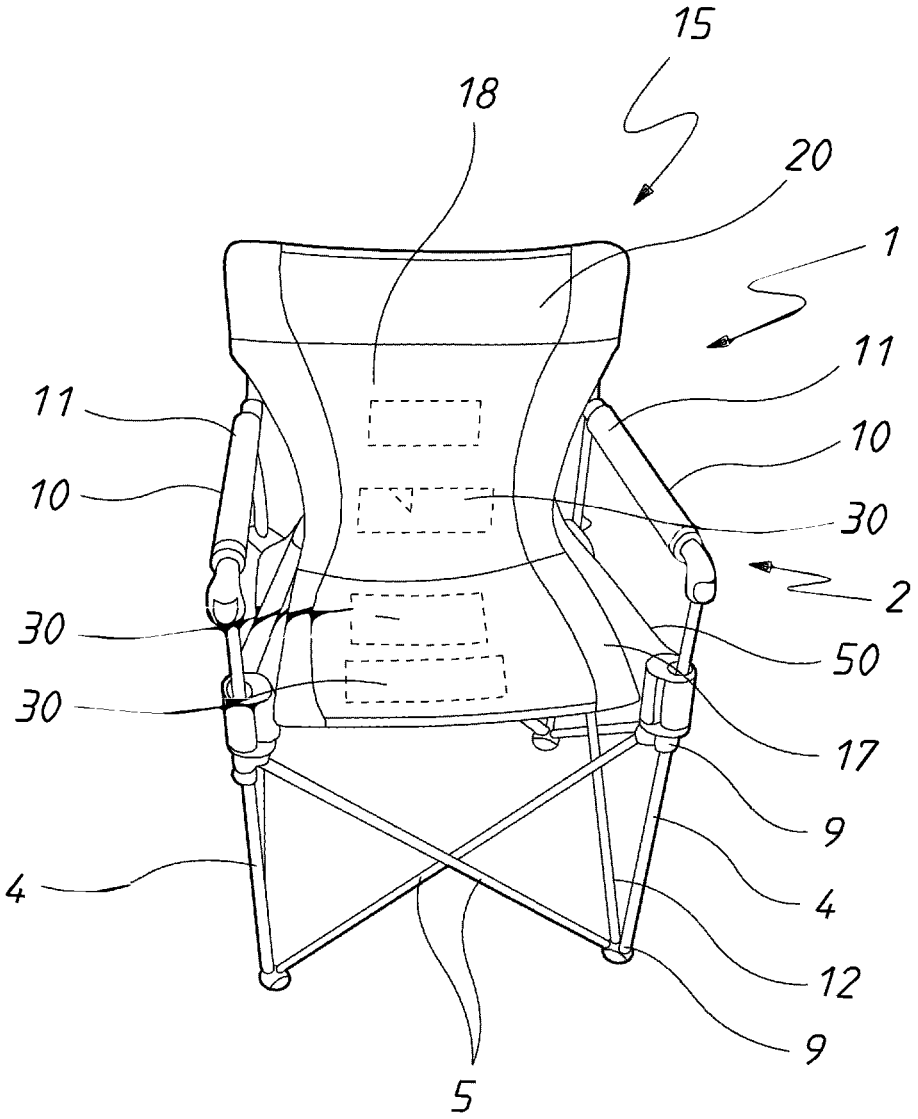
FIG. 2 shows a perspective front view of an embodiment of the present invention.

There is disclosed herein an outdoor and/or collapsible chair 1 having a frame 2. The frame 2 having a pair of elongate front members 4 in the form of poles, struts or the like spaced apart by at least one cross-member 5 also in the form of poles, struts or the like and as best seen in FIG. 2. The cross-members 5 could cross in front of each other (as shown in FIG. 2) or be in other configurations. The frame 2 further includes a pair of elongate rear members 7 also in the form of poles or the like spaced apart by at least one cross-member 8 in the form of poles, struts or the like and as best seen in FIG. 1. The cross-members 8 can cross each other (as shown in the figures) or be in any configuration. The cross-members 5 and 8 could be connected together or be attached to the front and rear members 4 and 7 by connectors 9 or the like. As shown in the drawings, the rear members 7 are longer than the front members 4 to provide space for a back or head rest. At least one side member 10 (as best seen in FIG. 2) extends between the front members 4 and rear members 7. The side member 10 could be at an end of the front and rear members 4 and 7 to form arm rests 11 which could be padded (as shown in FIG. 2) or could be in the form of structural braces 12. A seat 15 is adapted in use to be supported by the frame 2 between the side members 10. The seat 15 could be of any material, such as canvas, plastics, hessian, cotton or other suitable products. The seat 15 could be rigid or flexible. The seat 15 (as best seen in FIG. 2) includes a bottom portion 17 and a back portion 18. The portions 17 and 18 having a front surface 20 and a back surface 21. The back portion 18 could be attached to the rear members 7 by various fastening means however in FIG. 1 is shown utilising fabric pockets 23 within which an end of the rear member 7 slides into. The bottom portion 17 could be attached to the frame 2 by way of fastening straps 25 as best seen in FIG. 1. These straps 25 include a hollow portion 26 which is adapted to slide over the members 4, 7 as shown. It should however be noted that various different fastening mechanisms could be utilised to secure the seat 15 within the frame 2. At least one temperature controlling pocket or pouch 30 is located adjacent the bottom portion 17 and/or back portion 18 to provide in use temperature control to a region of the user when sitting in the chair 1.

In the preferred form, the pocket or pouch 30 is formed into the bottom portion 17 or back portion 18. The pocket 30 can include a fastening means such as a zip, hook and loop fastener, or the like 32 to close off a pocket opening 33. The pocket 30 is adapted in use to receive a temperature controlling device (not shown). The pocket 30 could also include a temperature controlling lining such as a heat or cooling reflective material. The pocket or pouch 30 could be releasably attachable to the seat 15 so that it can be used by a user away from the chair 1 or placed in boiling water, ice, or the like to assist with temperature regulation.

In the preferred form, the temperature controlling device is exothermic and includes sodium acetate. The temperature controlling device preferably would be removable from the chair 1 and replaceable depending upon the needs of the consumer. The temperature controlling device could also be placed in various different locations in various different pockets 30 about the chair 1 as required. The temperature controlling device would require no power supply and would be fitted ergonomically into the chair 1 such as below a cushioned portion or the like. The chair 1 could also include a lumbar support device 50, the lumbar support device 50 could be integrally formed with the temperature controlling device to direct heating and cooling to a targeted area of a user.

Advantageously, the present invention provides passive (exothermic chemical reaction) to provide heating or cooling in a chair 1 by way of the insulated pockets 30 with heat reflective material to radiate heating or cooling generated by the insertable temperature controlling pouches directly through the seat 15. The advantages are greater heating or cooling, longer operating time (for example up to one hour), easily reset as you simply put the pouch in a saucepan, boiling water or the like on a camp fire or such, multiple use of the pouches having a considerable life span, no energy lost when stored, ready for use at any time or day. Further, the present invention provides no cables, no batteries, is non-toxic, is fast, reusable, reliable, effective, convenient and safe.

Advantageously, the present invention provides passive (exothermic chemical reactions) to provide heating or cooling not only for outdoor and/or foldable chairs or the like but additionally the thermal pouch can be placed in sleeping bags, swags, bunkers, mattresses, therapeutic body straps, or even chair adaptor belts for furniture not fitted with insulated pockets.

Although the invention has been described with reference to specific examples, it will be appreciated by those skilled in the art that the invention may be embodied in many other forms.

The invention claimed is:

1. A chair having:

a frame, the frame having a pair of elongate front members spaced apart by at least one cross member; a pair of elongate rear members spaced apart by at least one cross member; at least one side member extending between each of said front and rear members;

a flexible seat, adapted in use to be supported by said frame between said side members, said seat having a bottom portion and a back portion, said portions having a front surface and a back surface;

a temperature controlling pocket located adjacent back portion to receive a temperature controlling device, and provide in use temperature control to a region of a user when sitting in said chair; and a lumbar support device integrally formed with said temperature controlling pocket to direct heating or cooling to a targeted area of a user and wherein said lumbar support device includes at least one support strap supportedly connecting said lumbar support to said pair of elongate front members.

2. The chair of claim 1, wherein said pocket is formed into said back portion.

3. The chair of claim 1, wherein said pocket includes fastening means to close a pocket opening.

4. The chair of claim 1, wherein said pocket includes a temperature controlling lining.

5. The chair of claim 4, wherein said lining includes heat reflective material.

6. The chair of claim 1, wherein said chair includes a cushioned portion, said pocket located substantially within said cushion.

7. The chair of claim 1, wherein said temperature controlling device is exothermic.

8. The chair of claim 1, wherein said temperature controlling device includes sodium acetate.

9. The chair of claim 1, wherein said chair includes a plurality of pockets providing in use heating and/or cooling to a user.

10. The chair of claim 9, wherein said pockets are formed into said bottom portion and/or said back portion.

11. The chair of claim 1, wherein said pocket is releasably attachable to said chair.

12. The chair of claim 1, wherein said chair is a collapsible chair.

13. The chair of claim 1, wherein said support strap is configured as a sling connecting said lumbar support to said pair of elongate front members.

* * * * *